US010344760B2

(12) United States Patent
Jackson et al.

(10) Patent No.: US 10,344,760 B2
(45) **Date of Patent: *Jul. 9, 2019**

(54) TOY FLUID PUMPING GUN

(71) Applicant: DEKA Products Limited Partnership, Manchester, NH (US)

(72) Inventors: James L. Jackson, Brookline, NH (US); Dean Kamen, Bedford, NH (US)

(73) Assignee: DEKA Products Limited Partnership, Manchester, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/837,185

(22) Filed: Dec. 11, 2017

(65) Prior Publication Data

US 2018/0100505 A1 Apr. 12, 2018

Related U.S. Application Data

(63) Continuation of application No. 14/715,027, filed on May 18, 2015, now Pat. No. 9,841,022, which is a continuation of application No. 12/581,244, filed on Oct. 19, 2009, now Pat. No. 9,033,191.

(60) Provisional application No. 61/106,240, filed on Oct. 17, 2008.

(51) Int. Cl.

| | |
|---|---|
| ***F04C 15/00*** | (2006.01) |
| ***F04C 2/18*** | (2006.01) |
| ***F04C 2/08*** | (2006.01) |
| ***F04C 13/00*** | (2006.01) |
| ***F04C 23/02*** | (2006.01) |
| ***F01C 1/18*** | (2006.01) |
| ***F01C 13/02*** | (2006.01) |
| ***F01C 17/06*** | (2006.01) |

(52) U.S. Cl.

CPC ..... *F04C 15/0061* (2013.01); *F01C 1/18* (2013.01); *F01C 13/02* (2013.01); *F01C 17/063* (2013.01); *F04C 2/084* (2013.01); *F04C 2/18* (2013.01); *F04C 13/00* (2013.01); *F04C 13/001* (2013.01); *F04C 23/02* (2013.01); *F04C 2210/1094* (2013.01)

(58) Field of Classification Search

CPC ..... F04C 15/0061; F01C 1/18

USPC ... 222/79, 323, 324, 372, 383.1, 383.2, 467, 222/478

See application file for complete search history.

(56) References Cited

U.S. PATENT DOCUMENTS

| | | | | | |
|---|---|---|---|---|---|
| 1,670,210 | A * | 5/1928 | Parker | F16N 3/12 | 222/323 |
| 3,202,318 | A * | 8/1965 | Black | B05B 9/0426 | 222/130 |
| 4,733,799 | A * | 3/1988 | Wiskur | F41B 9/0037 | 124/65 |
| 4,750,641 | A * | 6/1988 | Chin-Fu | F41B 9/0037 | 222/318 |

(Continued)

*Primary Examiner* — Vishal Pancholi

(74) *Attorney, Agent, or Firm* — Michelle Saquet Temple

(57) ABSTRACT

A fluid pumping device is disclosed. The fluid pumping device includes a housing having a front end and a rear end, a fluid discharge opening in the front end of the housing, a pump assembly, a crank assembly rotatably connected to the pump assembly wherein the crank assembly operates the pump assembly, and a fluid storage reservoir connected to the gear housing from which fluid is drawn into the gear housing to be pumped through the fluid discharge opening.

20 Claims, 18 Drawing Sheets

(56) References Cited

U.S. PATENT DOCUMENTS

| | | | | | |
|---|---|---|---|---|---|
| 5,184,756 | A * | 2/1993 | Amron | F41B 9/0018 | 222/400.8 |
| 5,538,457 | A * | 7/1996 | Deal | A63H 33/30 | 222/212 |
| 5,605,253 | A * | 2/1997 | Luk | F41B 9/004 | 222/382 |
| 5,660,159 | A * | 8/1997 | Clayton | F41B 11/54 | 124/59 |
| 5,730,325 | A * | 3/1998 | Cheung | F41B 9/0037 | 222/255 |
| 5,829,635 | A * | 11/1998 | Brovelli | F41B 9/0037 | 222/39 |
| 6,658,779 | B2 * | 12/2003 | Bauer | B65D 83/202 | 222/79 |
| 7,163,009 | B2 * | 1/2007 | Brown | F41B 7/00 | 124/76 |
| 2005/0098577 | A1 * | 5/2005 | Huy | F41B 9/0031 | 222/79 |
| 2006/0163278 | A1 * | 7/2006 | Yeung | A63H 33/28 | 222/79 |

* cited by examiner

TOY FLUID PUMPING GUN

CROSS REFERENCE TO RELATED APPLICATIONS

The present application is a Continuation of U.S. patent application Ser. No. 14/715,027 filed May 18, 2015 and entitled Toy Fluid Pump Gun, now U.S. Pat. No. 9,841,022, issued Dec. 12, 2017, which is a Continuation of U.S. patent application Ser. No. 12/581,244 filed Oct. 19, 2009 and entitled Toy Fluid Pump Gun, now U.S. Pat. No. 9,033,191, issued May 19, 2015, which is a non-provisional Application that claims priority from U.S. Provisional Patent Application Ser. No. 61/106,240, filed Oct. 17, 2008 and entitled Toy Fluid Pumping Gun, each of which is incorporated herein by reference in its entirety.

TECHNICAL FIELD

The present invention relates to toy fluid pumping devices and more particularly, to a toy fluid pumping gun.

BACKGROUND INFORMATION

Toy fluid pumping devices have been around for decades and various types are described in the prior art. There are many different configurations of pump systems for these toy guns. Some users of toy fluid pumping devices desire greater streams of fluid. However, in many cases, children may not have the strength to pump faster and with more force to provide the greater stream of fluid. Furthermore, pumping devices utilizing air chambers may be a safety hazard if the chambers become fatigued and explode and many of these models may not be refilled unless emptied and depressurized. Also, some users desire a continuous stream of fluid.

Motorized electric pumps used in pump devices may address some of the stated problems but create others. However, pumping devices with electric pumps tend to be heavier and bulkier. Also, greater complexities are introduces with electric pumps, some of these complexities may contribute to increase the weight of the pumping device and may increase the overall cost of the device. Additionally, some electric devices require a power source, e.g. batteries, which require replacement or recharging, and thus, may contribute to increased expense for use. In addition, combining water with electricity and/or a power source may introduce additional safety hazards.

Accordingly, there is a need for a toy fluid pumping device that may provide a continuous stream of fluid in a manor that may be operated easily by a user and does not provide a safety hazard or require a power source to operate.

SUMMARY

In accordance with one aspect of the present invention, a fluid pumping device is disclosed. The fluid pumping device includes a housing having a front end and a rear end, a fluid discharge opening in the front end of the housing, a pump assembly, a crank assembly rotatably connected to the pump assembly wherein the crank assembly operates the pump assembly, and a fluid storage reservoir connected to the gear housing from which fluid is drawn into the gear housing to be pumped through the fluid discharge opening.

Some embodiments of this aspect of the present invention may include one or more of the following. Where the pump assembly includes a first gear and a second gear where the first gear is larger in diameter than the second gear and wherein the gear ratio between the first gear and the second gear is 15:1. The fluid pumping device may further include at least one nozzle attached to the opening in the front end of the housing. The fluid pumping device may further include at least one removable nozzle removably attached to the front end of the housing. The fluid pumping device may further include wherein the crank assembly further includes a crank arm and a crank handle connected to the crank arm. In some embodiments, the crank arm further includes at least one notch and wherein the crank handle may be connected to the crank arm through the at least one notch. In some embodiments the fluid pumping device may further include wherein the crank arm further includes at least two notches and wherein the crank handle may be connected to the crank arm through any one of the at least two notches whereby the length of the crank arm is determined by the position of the crank handle. The fluid pumping device may include at least two removable nozzles, each nozzle having a different diameter opening. Also, may include wherein the at least two removable nozzles are stored on the device housing. The fluid pumping device may include where the pump assembly includes at least one pair of gears, wherein each pair of gears having a large gear and a pinion gear In some embodiments, the fluid pumping device may include wherein the gear at least one pair of gears having a gear ratio of 4:1.

In accordance with another aspect of the present invention, a toy water gun is disclosed. The toy water gun includes a housing having a front end and a rear end, a fluid discharge opening in the front end of the housing, a pump assembly comprising at least one pair of gears, wherein each pair of gears having a large gear and a pinion gear, a crank assembly rotatably connected to the pump assembly wherein the crank assembly operates the pump assembly, and a fluid storage reservoir connected to the gear housing from which fluid is drawn into the gear housing to be pumped through the fluid discharge opening.

Some embodiments of this aspect of the present invention may include one or more of the following. Where the gear at least one pair of gears having a gear ratio of 4:1. Wherein the gear ratio between the at least one pair of gears 15:1. Wherein the toy gun further includes at least one nozzle attached to the opening in the front end of the housing. Wherein the toy gun further includes at least one removable nozzle removably attached to the front end of the housing. Wherein the crank assembly further includes a crank arm, and a crank handle connected to the crank arm. Wherein the crank arm further includes at least one notch and wherein the crank handle may be connected to the crank arm through the at least one notch. The toy gun may include wherein the crank arm further includes at least two notches and wherein the crank handle may be connected to the crank arm through any one of the at least two notches whereby the length of the crank arm is determined by the position of the crank handle. The toy gun may include at least two removable nozzles, each nozzle having a different diameter opening. The toy water gun may include wherein the at least two removable nozzles are stored on the device housing.

In accordance with another aspect of the present invention, a toy water gun is disclosed. The toy water gun includes a housing having a front end and a rear end, a fluid discharge opening in the front end of the housing, at least two removable nozzles, each nozzle having a different diameter opening, also, a pump assembly including at least one pair of gears, wherein each pair of gears having a large gear and a pinion gear. The toy gun additionally includes a crank assembly rotatably connected to the pump assembly wherein the crank assembly operates the pump assembly and a fluid storage reservoir connected to the gear housing from which fluid is drawn into the gear housing to be pumped through the fluid discharge opening.

Some embodiments of this aspect of the present invention may include one or more of the following. Wherein the at least one pair of gears comprising a gear ratio of 15:1. Wherein the gear at least one pair of gears having a gear ratio of 4:1. Wherein the at least two removable nozzles are stored on the housing. Wherein the crank assembly further includes a crank arm and a crank handle connected to the crank arm. In some embodiments the crank arm further includes at least one notch and wherein the crank handle may be connected to the crank arm through the at least one notch. In some embodiments, the crank arm further includes at least two notches and wherein the crank handle may be connected to the crank arm through any one of the at least two notches whereby the length of the crank arm is determined by the position of the crank handle.

These aspects of the invention are not meant to be exclusive and other features, aspects, and advantages of the present invention will be readily apparent to those of ordinary skill in the art when read in conjunction with the appended claims and accompanying drawings.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

The following paragraphs demonstrate embodiments of a fluid pumping device which may be used as a toy water gun. Fluids that may be pumped by the device include, but are not limited to water, gasoline, oil, glucose solution, and other solutions such as acidic, basic, and organic solutions, and any other liquids desired to be pumped to a stream of fluid to be expelled a distance from the pumping device. The fluid pumping device pumps fluid when a user turns a crank assembly to engage a pump. The pump draws fluid from the reservoir, through the pump, and out an opening. The fluid is thus expelled from the opening a distance from the pumping device. When used as a toy water gun, in some embodiments, the fluid pumping device may expel the fluid at least as far as 45 feet from the pumping device, and in some embodiments, this distance may be further. In some embodiments, the device may be equipped to limit the distance of the stream of fluid. In some embodiments, the distance of the stream of fluid depends at least on the speed and force applied to turn the crank assembly can be turned. Some embodiments include an adjustable crank arm that may be adjusted to apply greater force to create a farther stream of water. Further, in another embodiment, removable nozzles may be used to increase the distance fluid may be expelled.

As used herein, the term "fluid" may be any fluid, including, but not limited to water. The term "toy" is used to refer to a device or object that may be used for play.

Figure 1:
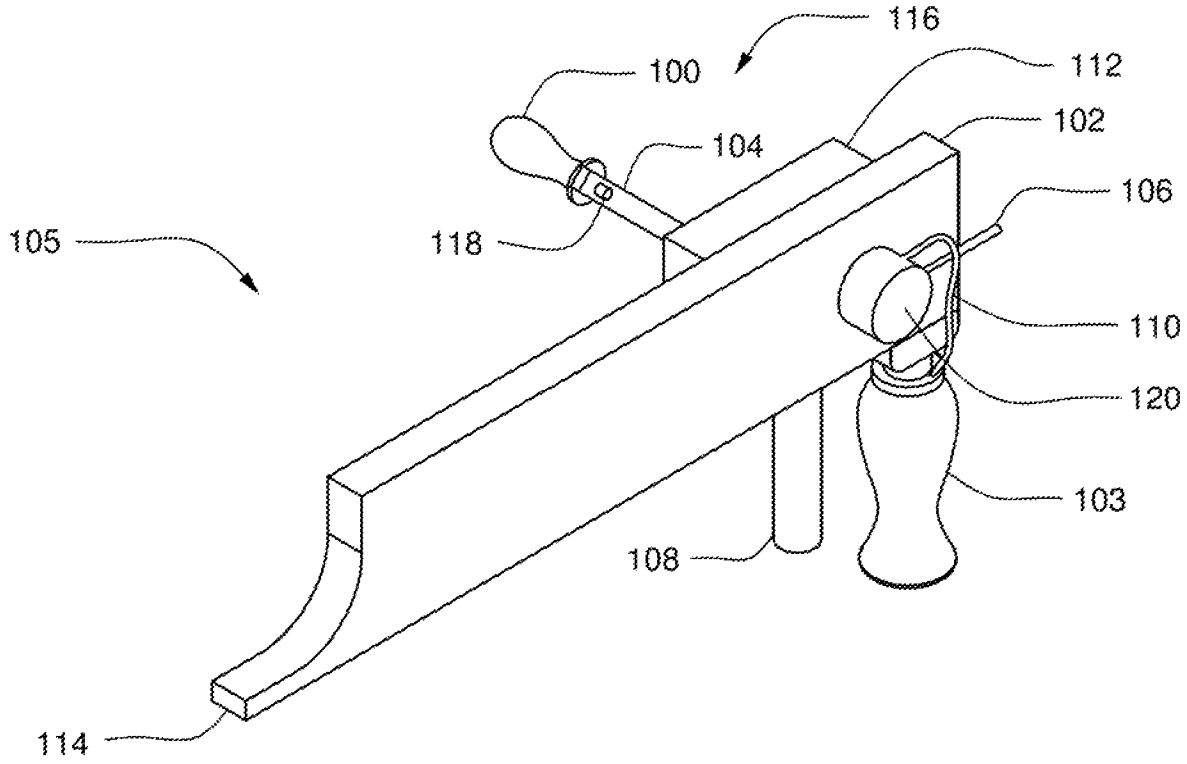
FIG. 1 is a side view of an exemplary embodiment of a fluid pumping device.
Figure 2:
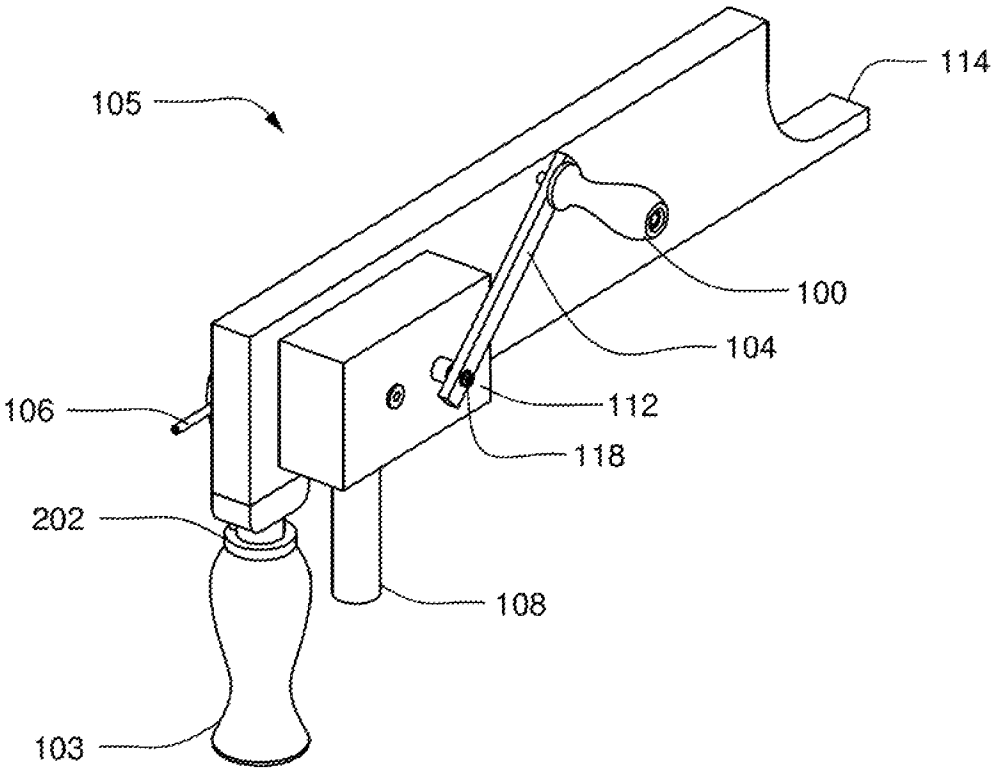
FIG. 2 is a side view of the crank assembly coupled to the housing.

An exemplary embodiment of a fluid pumping device is shown at 105 in FIG. 1. Fluid pumping device 105 may have a housing 102 which may have a front end and a rear end 114. The rear end 114 may be shaped to be held against the shoulder of the user as shown in FIG. 1. The housing in an exemplary embodiment shown in FIG. 1 is made from wood, about ¾" in width, and about 26" in length, from rear end 114 to fluid discharge opening 106. The housing 102 may be of any suitable length, material, or shape. The housing in the exemplary embodiments in FIG. 1. and FIG. 2 is about 26" in length, but can be longer or shorter depending on the desired size of the device. The housing 102 may contain all tubing and parts of the device 105, including a reservoir 103. The rear end 114 may have a lip that extends from the housing, and in one embodiment, extends about 3" from the rest of the housing to be placed under the user's arm for more leverage. Without the lip, the housing in the exemplary embodiment shown in FIG. 1 would be about 23" in length. A pump housing 112 may be connected to one side of the housing 102. The pump housing 112 may enclose a pump assembly to protect the pump assembly from breakage and hide the pump assembly from view for aesthetic purposes. The pump housing 112 in the embodiment shown in FIG. 1 is located about 2" from the fluid discharge opening 106, however, other embodiments may place the pump housing 112 in any suitable place depending on the desired size of the device. A pump assembly may be located inside pump housing 112. Any of the embodiments of the pump assembly may be operated by an electric motor. Also, in some embodiments, a commercial pump assembly such as one made by Jersey Modeler, in Toms River, N.J. may be used. In this embodiment, the pump assembly comes attached to a fuel can, however, it may be specially ordered separately from the can. The fuel cans it is sold with are the 2.5SPER and 5.0SPEFR cans.

A crank assembly 116 may be rotatably attached to the pump assembly 400 and may have a crank arm 104 and a crank handle 100 which is attached to the crank arm by screw 118. The crank assembly 116 engages the pump assembly when turned by the user to facilitate fluid movement to the pump assembly through fluid discharge opening 106. Fluid pumping device 105 may have a handle 108 that may be attached to the housing 102. Handle 108 may be used to hold the fluid pumping device 105 steady while turning crank assembly 116. The embodiment shown in FIG. 1 has the rear end of the housing 114 shaped to be held against the shoulder of the user, which would be useful if the desired embodiment is a large version of the fluid pumping device 105. A reservoir 103 may be connected to the pump housing 112 via tubing 110 which also may connect internally to a fluid discharge opening 106 for expelling water from the fluid pumping device 105. The reservoir 103 may be located inside the housing 102 in an alternate embodiment.

Figure 3:
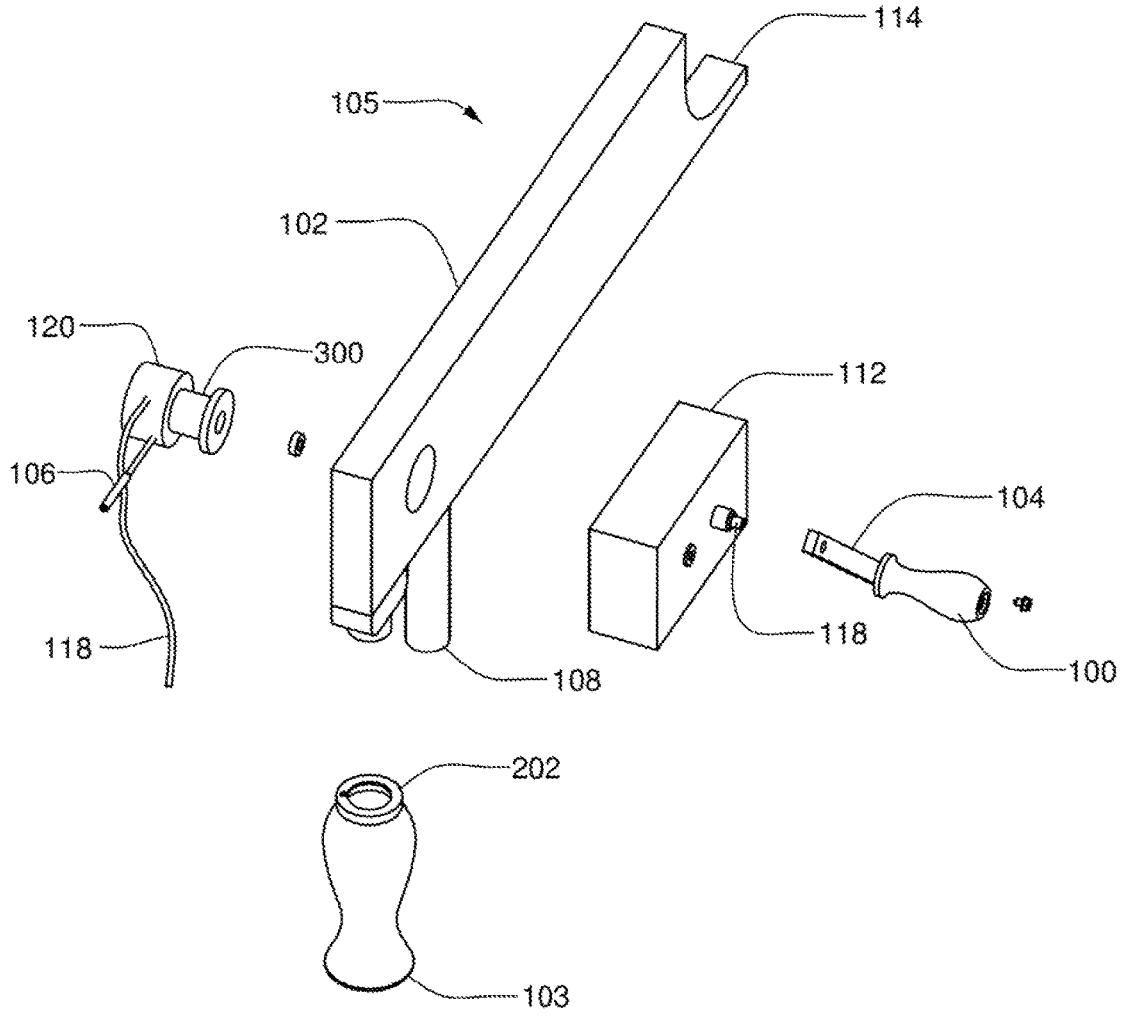
FIG. 3 is an exploded view of various parts of the fluid pumping device.

FIG. 3 shows an exploded view of the fluid pumping device 105. A shaft housing 120 is connected to the reservoir 103 and the fluid discharge opening 106 by tubing 110. The shaft housing 302 is connected to the crank arm 104 by crank shaft 300. Reservoir 103 may include a bottle with a screw top 202 which may be attached to the pump via tubing 110 as shown in FIG. 2 and FIG. 3. The tubing 110 in the exemplary embodiment may be 3⁄16" IED silicone tubing. However, in other embodiments the inside diameter of the tubing 110 may be smaller than 3⁄16" but may have an effect on the distance fluid can be launched. Alternate embodiments may include tubing of different sized diameter or different materials, including but not limited to flexible plastic. The reservoir in the exemplary embodiment is made from plastic, but may be made from any material sufficient to hold the fluid that is to be pumped. In the exemplary embodiment, the reservoir is adapted to hold a maximum volume 24 ounces of fluid (and in these embodiments, the reservoir may be filled to a volume less than the maximum volume, e.g., less than 24 ounces). However, in other embodiments, the reservoir may be constructed or designed to hold less than 24 ounces or greater than 24 ounces of liquid. Alternate embodiments may contain multiple reservoirs that are attached with tubing or one larger or smaller reservoir than shown in the exemplary embodiment. A large reservoir or multiple reservoirs could be worn strapped to the belt or the back of a user to increase the fluid available and decrease refilling. The reservoir 103 may have a filter, a weight, or both (not shown). The weight would be located inside the reservoir connected to the end of the tubing, to keep the filter, the tubing, or both at the bottom of the reservoir so when fluid levels go down the tubing is still lower than the fluid level. The filter, also located inside the reservoir and connected to the end of the tubing, serves to filter out anything that may have been put into the reservoir that could prevent proper functioning of the pump assembly, such as sand. The filter may be a clunk filter having four pieces, including a top, bottom, gasket to seal and a filter or screen. An alternate embodiment may have more than one filter, such as a primary filter and a secondary filter further upstream. The tubing 110 may be located inside a housing, inside housing 102, external to the fluid pumping device 105, or any other suitable location allowing water to be drawn from the reservoir. The reservoir 103 may be located inside the housing 102, inside an alternate housing, outside of the fluid pumping device 105, or any other suitable location that still allows water to be drawn from the reservoir.

Figure 1A:
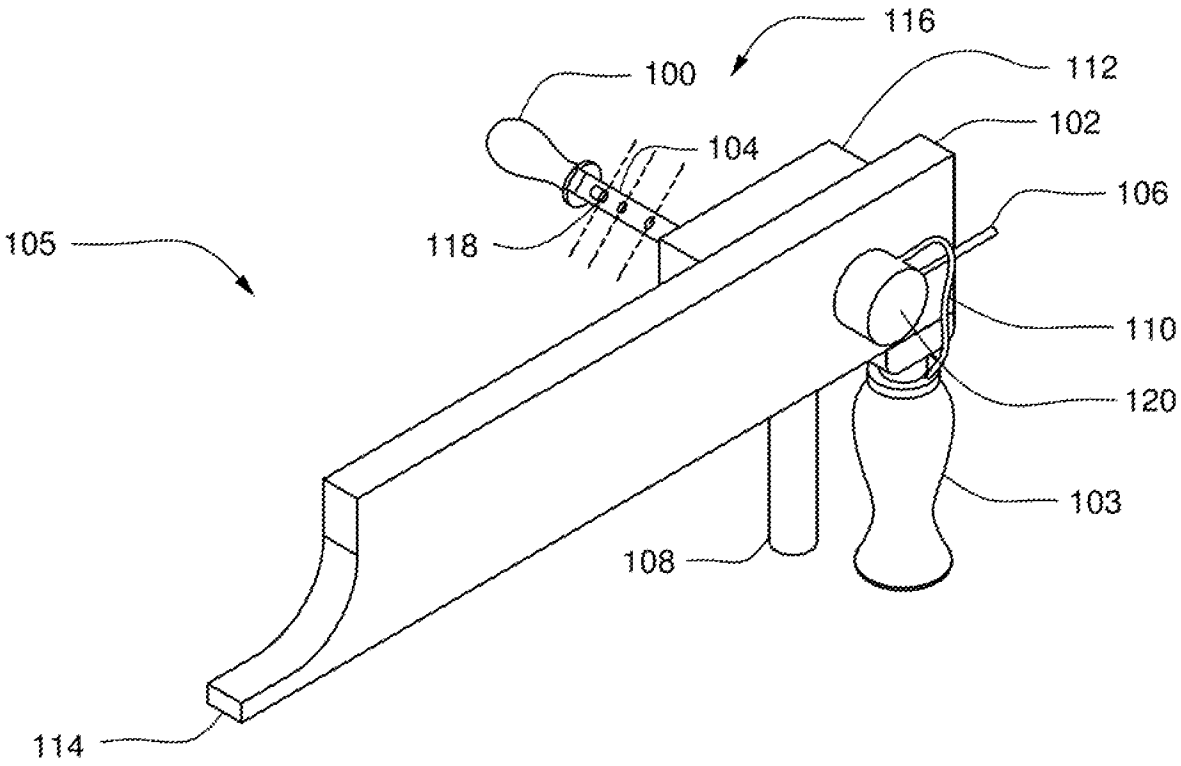
FIG. 1A is a view of an exemplary embodiment of a fluid pumping device with an adjustable crank arm.
Figure 2A:
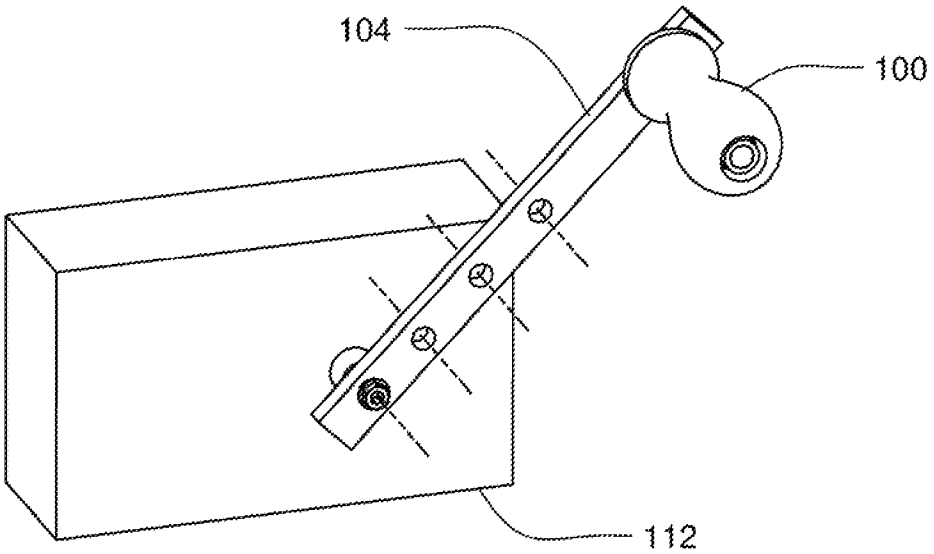
FIG. 2A is a view of an embodiment of a fluid pumping device with notches to adjust the crank arm.
Figure 2B:
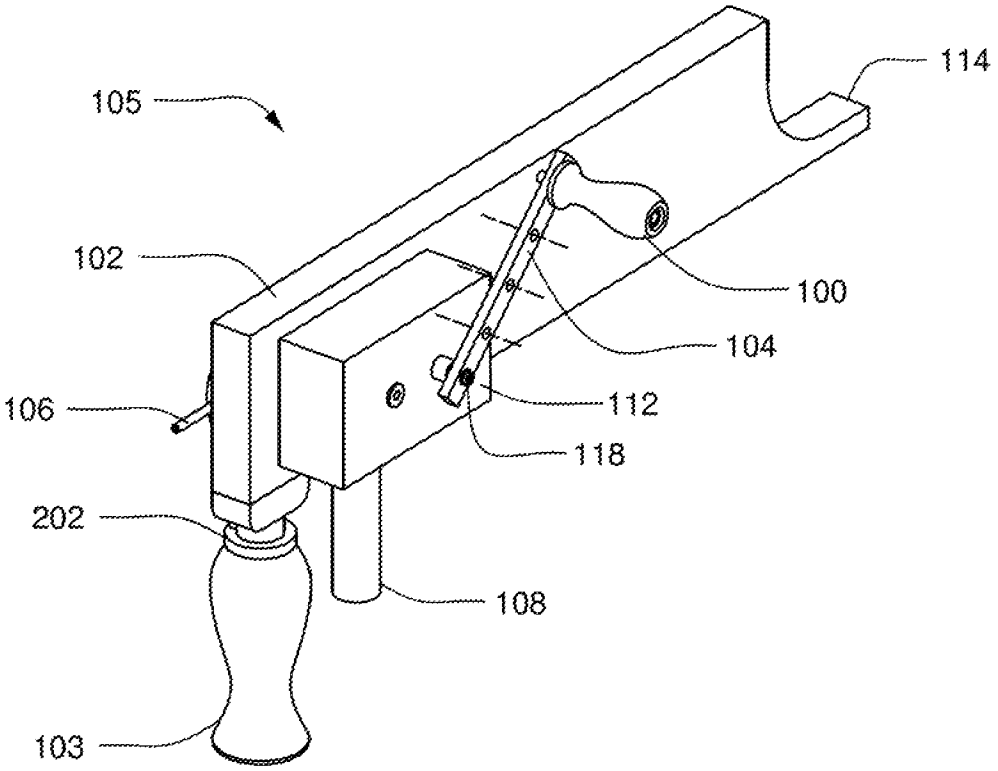
FIG. 2B is a side view of an embodiment of a fluid pumping device having a an adjustable crank arm with notches to adjust the length of the arm.
Figure 3A:
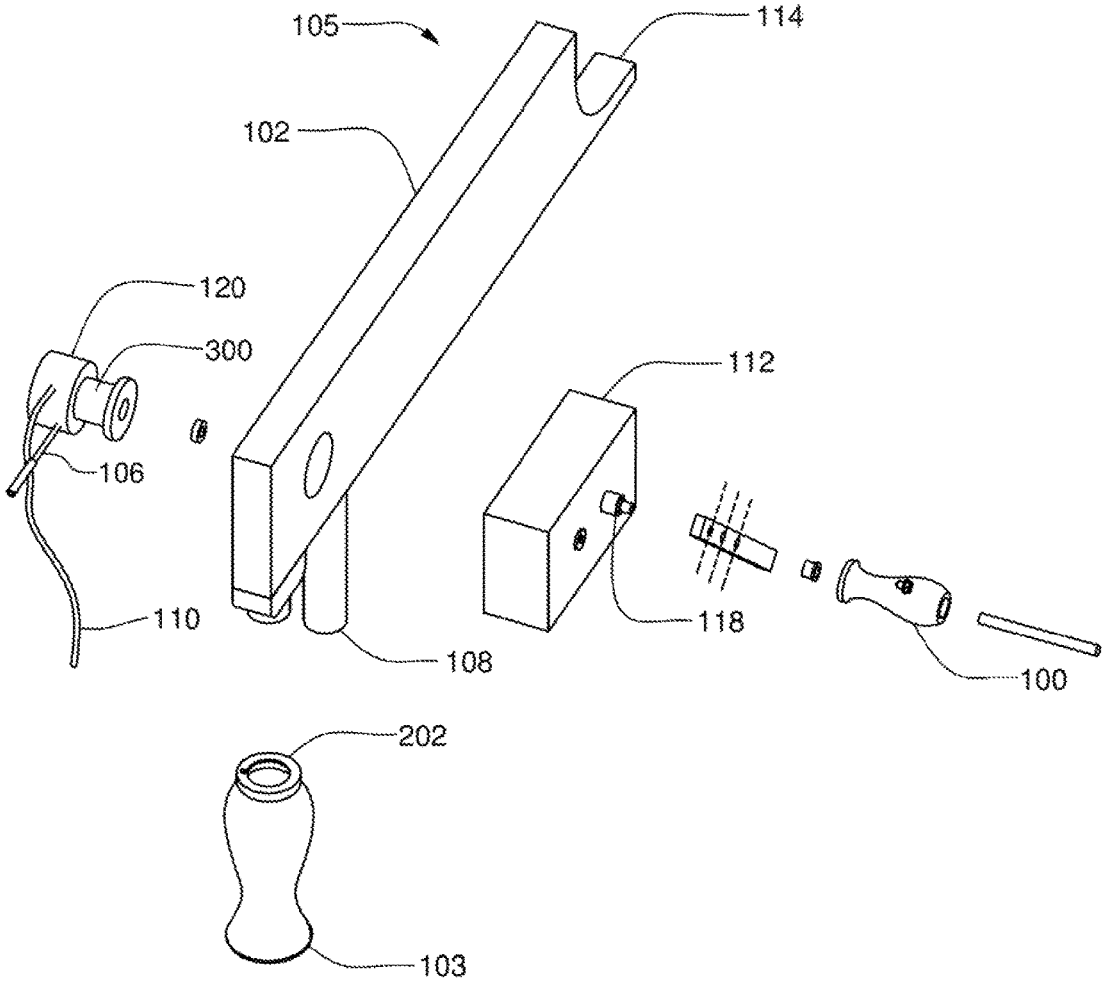
FIG. 3A is an exploded view of the various parts of an embodiment of the fluid pumping device.

FIG. 2A shows an exemplary embodiment of fluid pumping device 105 having an adjustable crank arm 104. The crank arm 104 may have one or more notches into which a screw may be slid via a notch slide. The crank assembly 112 has a crank arm 104 and a handle 100. The notches change the length of the arm, allowing greater pressure build up of pressure while turning the crank. There may be any amount of notches present, depending on the size of the gun 105, the length of crank arm 104, and the desired range in arm length. The crank arm 104 may be made of wood, plastic, metal, or any material having the following characteristics, including, but not limited to: sturdiness to turn the crank assembly without breaking, compatibility with fluid, especially water, and having feasible weight and cost. Alternate embodiments include, but are not limited to, a crank arm that slides on a track with a removable peg to secure the arm, a crank arm with notches and a screw that slides, as shown in FIG. 2A, or an adjustable crank arm that is removable and able to be replaced with a shorter or longer arm. FIG. 1A and FIG. 2B illustrate an embodiment of a fluid pumping device 105 having an adjustable crank arm with notches. FIG. 3A is an exploded view of one embodiment of a fluid pumping device with an adjustable crank arm, using notches. Although in the various embodiments shown, the crank arm 104 includes two or three notches, in various embodiments, the crank arm 104 may include less than 2 notches, or greater than 2 notches, and the notches may be located in any position desired on the crank arm 104. In other embodiments, a split collar with a screw knob can grip a round shaft and be variably adjustable within the arm length.

Figure 4:
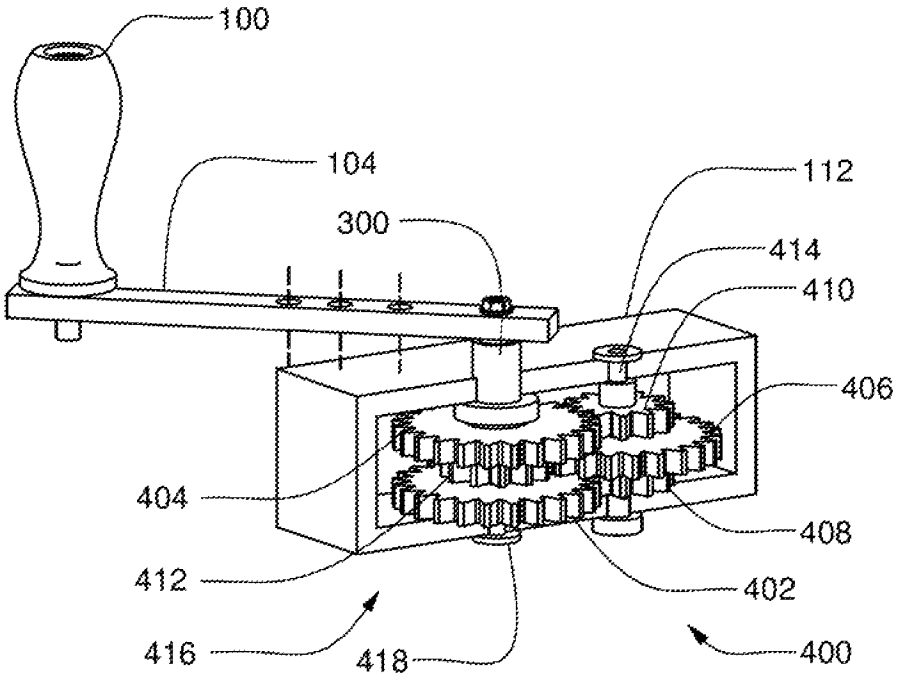
FIG. 4 is a view of an embodiment of a gear pump and the crank assembly.
Figure 4A:
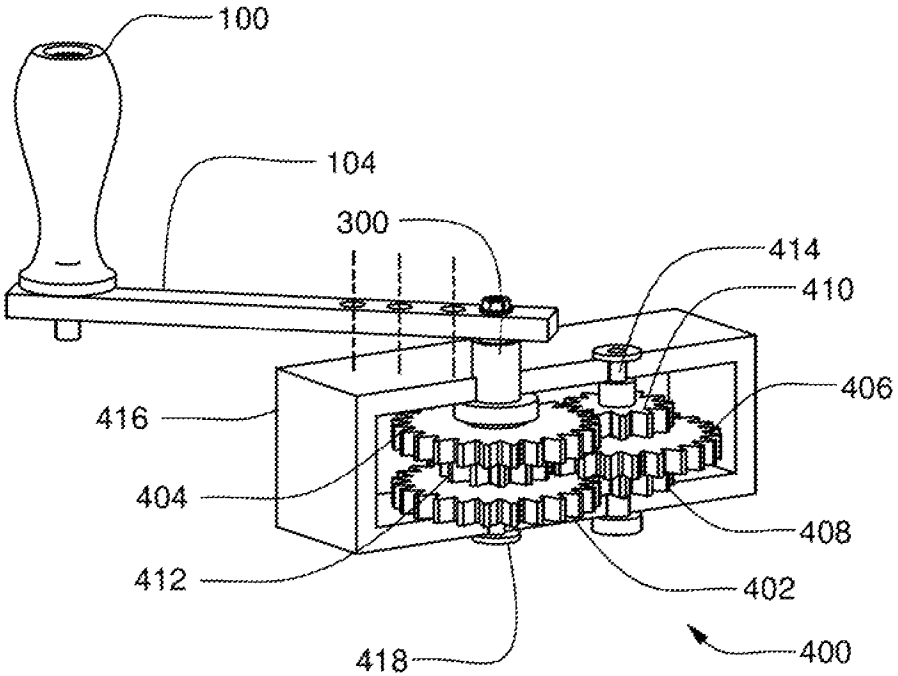
FIG. 4A is view of an embodiment of a pump assembly with an adjustable crank arm having notches.
Figure 5:
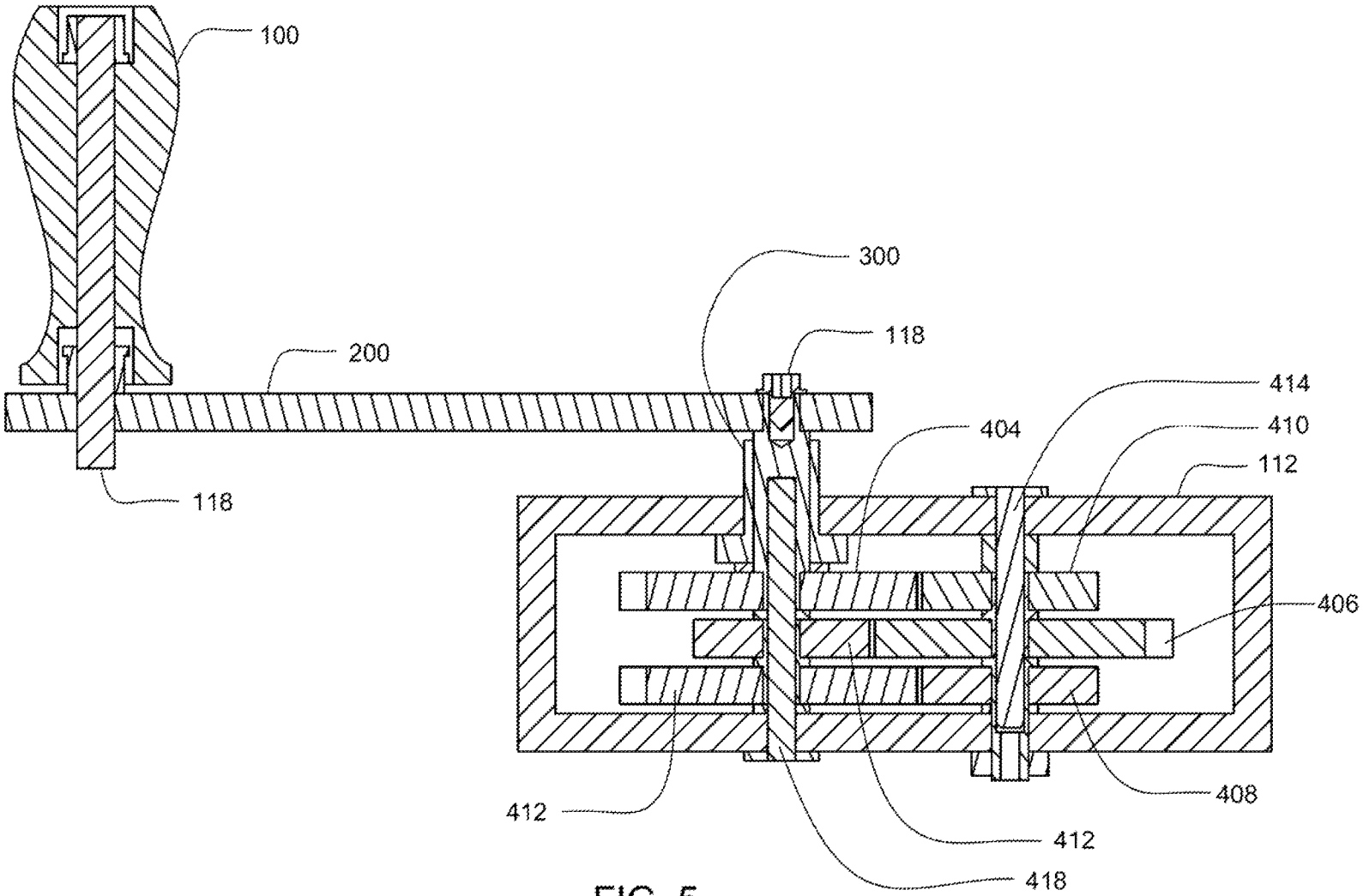
FIG. 5 is a cross sectional view of the pump assembly in FIG. 4.
Figure 5A:
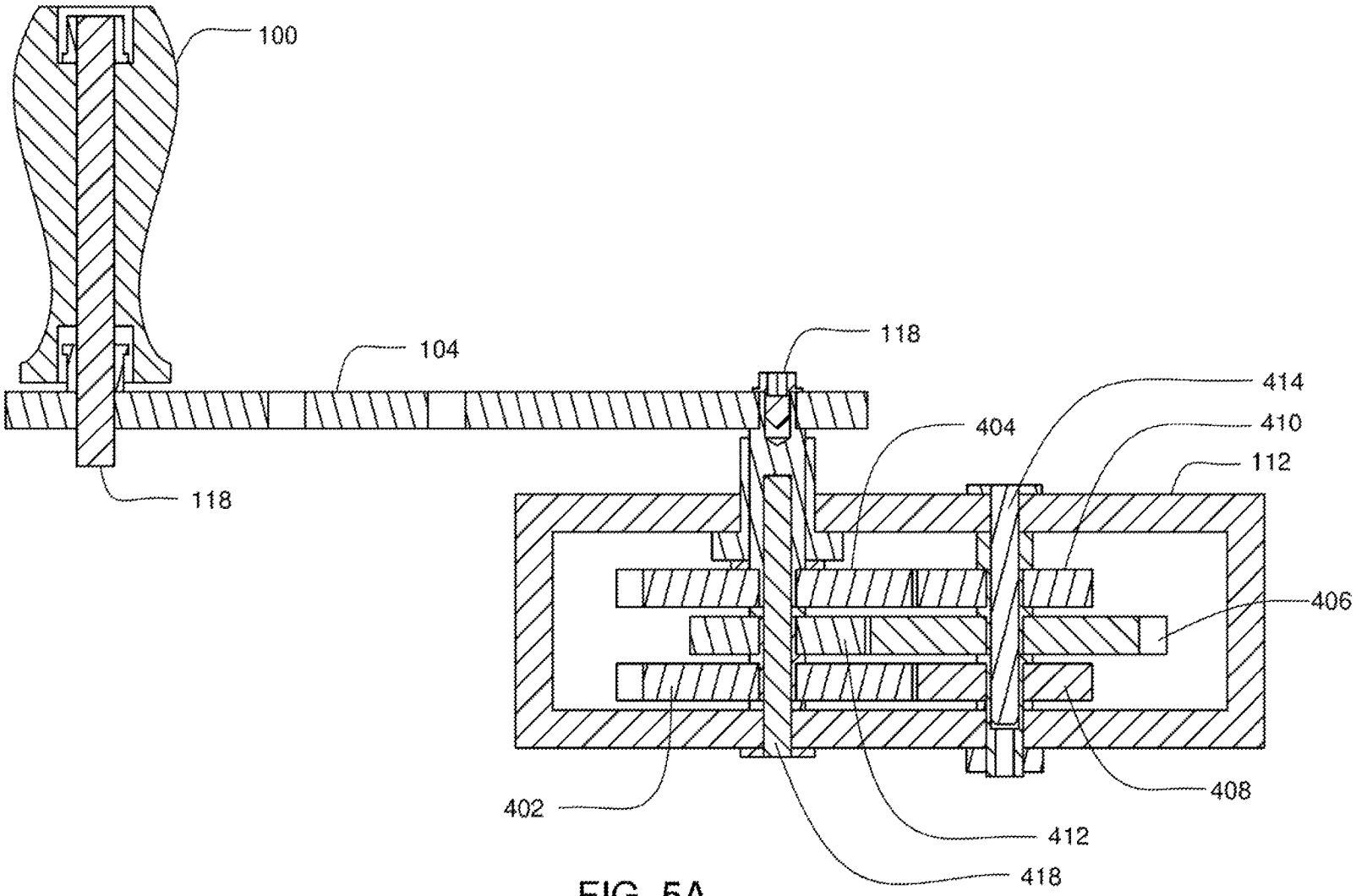
FIG. 5A is a cross sectional view of the pump assembly in FIG. 4A.

An exemplary embodiment of a pump assembly is shown at 400 in FIG. 4. The pump assembly 400 may be operated by turning crank assembly 116, engaging gear 404 and subsequently gear train 416. The pump assembly 400 may have multiple pairs of gears, each having a large gear and a pinion gear. FIG. 4 shows an exemplary embodiment with six gears, three large gears 402, 404, 406, and three pinion gears 408, 410, 412, having a gear ratio of 4:1. The gears used may be any known in the art, for example gears from Eastern Bearings, Inc. in Manchester, N.H. The manufacturer of the gears is Boston Gears, Co. Gears shown in FIG. 4. may be brass and may need to be polished, or could be made of plastic or any other material, including but not limited to those materials that can withstand being surrounded by the fluid being pumped without corrosion and can be used to make intermeshing gears. In some embodiments, the gear ratio may be larger or smaller than 4:1. Gears 402, 404, 406, 408, 410, and 412 rotate around a shaft 414, which may be of 3⁄16" diameter and made of brass or any other material that may be sturdy enough to allow gears to rotate but creates little enough friction for the gears to turn. Ball bearings may be used instead of a smooth shaft if friction is affecting the operation of the crank assembly 116. In one embodiment, ball bearings may be standard ball-bearings with a 3⁄16" bore and a ¼" face. Gears could be of differing number and size to form alternate embodiments, for example, there could be eight or four gears rather than six. For example, fewer gears may be used in some embodiments which may reduce the friction areas of the shafts and the number of tooth faces that need to slip against each other. This embodiment may be slightly easier to operate. The pump assembly 400 may be located inside pump housing 112 or may be located elsewhere within housing 102. FIG. 4A is an example of a pump assembly like that shown in FIG. 4 but having an adjustable crank arm with notches.

In some embodiments, the pump assembly includes two gears, a larger gear and a smaller gear having a large gear ratio, e.g., 15:1. However, in various embodiments, this ratio may be larger or smaller than 15:1. In the various embodiments having a larger gear ratio, however, friction is reduced to two points, i.e., at the gear mesh and the crankshaft. In some embodiments, bearings are used, as discussed above, however, with two gears; the number of bearings is greatly reduced. In these embodiments, the total cost for the parts of the pump is reduced and the device may include a smaller profile. The smaller profile may be advantageous for many reasons, including, but not limited to, weight and design of crank assembly housings which may effect the overall weight of the device and/or the overall profile of the device.

Figure 6:
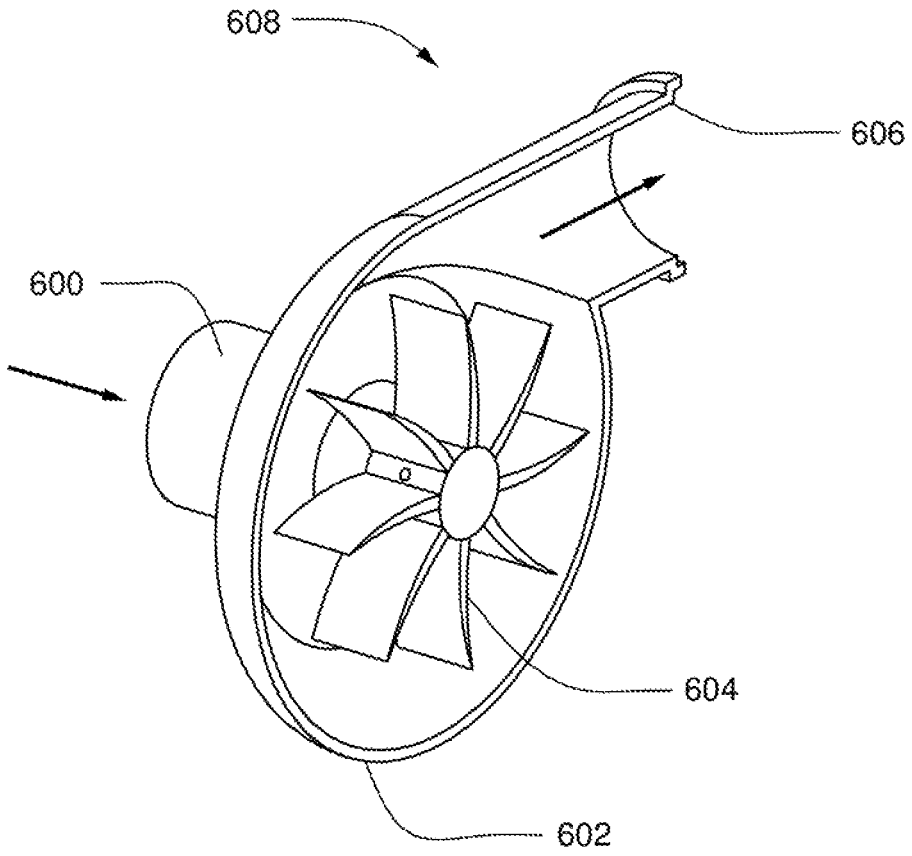
FIG. 6 is an illustrative view of an embodiment of a pump assembly having a pinwheel.

FIG. 6 is an illustration of the variety of pump assemblies that may be used in the various embodiments of the fluid pumping device. As shown in FIG. 6, the gear pump assembly shown in the FIG. 4 embodiment may be replaced with at least one pinwheel. Thus, a pinwheel pump assembly 608 may include a fluid inlet opening 600, a pump casing 602, a pinwheel 604, and a fluid outlet opening 606. The arrows in FIG. 6 show the direction of fluid movement through the pump assembly 608. To operate, the crank assembly 116 would be turned to engage the pinwheel 604, moving fluid through the pump assembly and drawing fluid in through fluid inlet opening 600 while forcing fluid out of fluid outlet opening 606. The pinwheel 608 may be made from any material that can move fluid through the pump assembly, including but not limited to plastic.

Figure 7:
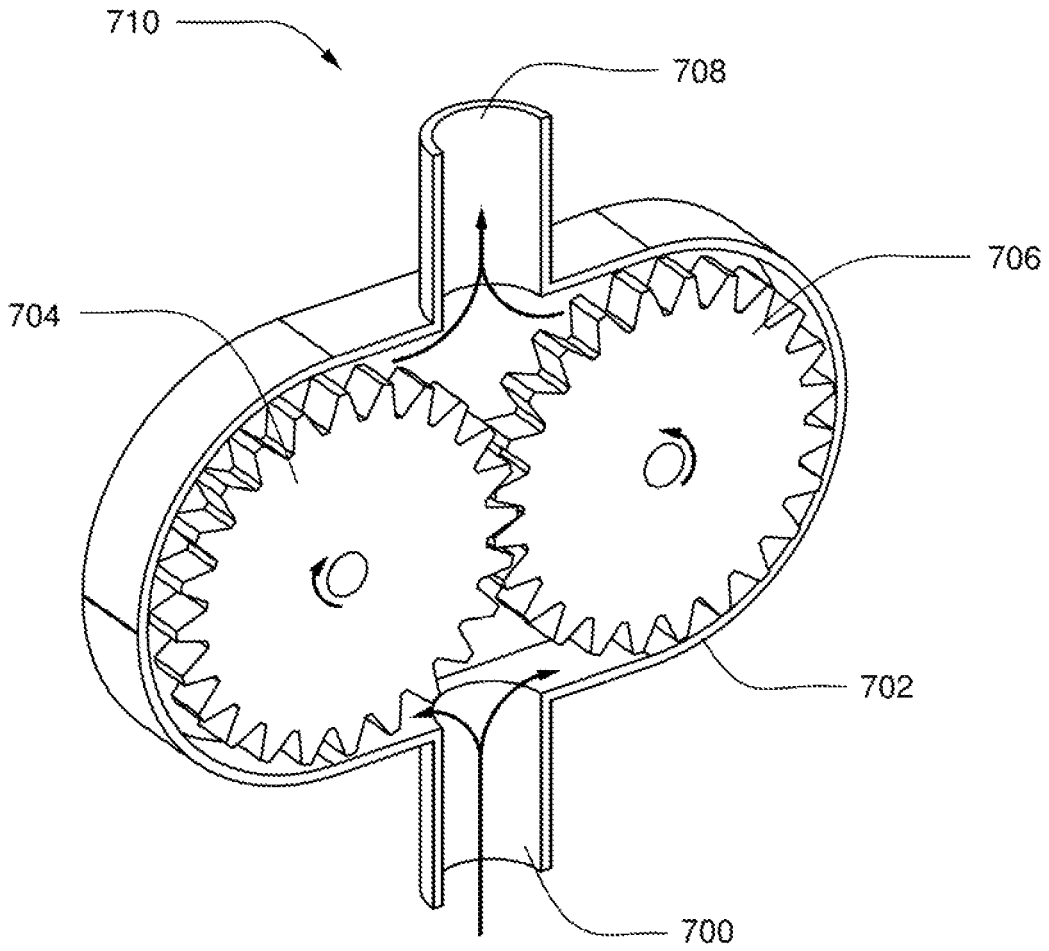
FIG. 7 is a view of an embodiment of a gear pump having a pair of gears and arrows indicating fluid movement through the pump.

FIG. 7 shows an alternate embodiment of a pump assembly. In this embodiment, the gear pump assembly shown in the FIG. 4 embodiment is replaced with a simple gear pump assembly 710 that includes a fluid inlet opening 700, a gear casing 702, two intermeshing gears 704 and 706, and a fluid outlet opening 708. The arrows in FIG. 7 indicate fluid movement through the simple gear pump assembly 710. The assembly 710 may be operated by turning crank assembly 116 causing gear 704 to rotate clockwise, engaging gear 706 to rotate counter clockwise and forcing fluid out of fluid outlet opening 708 and drawing fluid in through fluid inlet opening 700. The crank assembly could also engage gear 706 to rotate counter clockwise, creating the same effect. The gears used may be any known in the art, including those from Boston Gears Inc. in Manchester, N.H.

Figure 8:
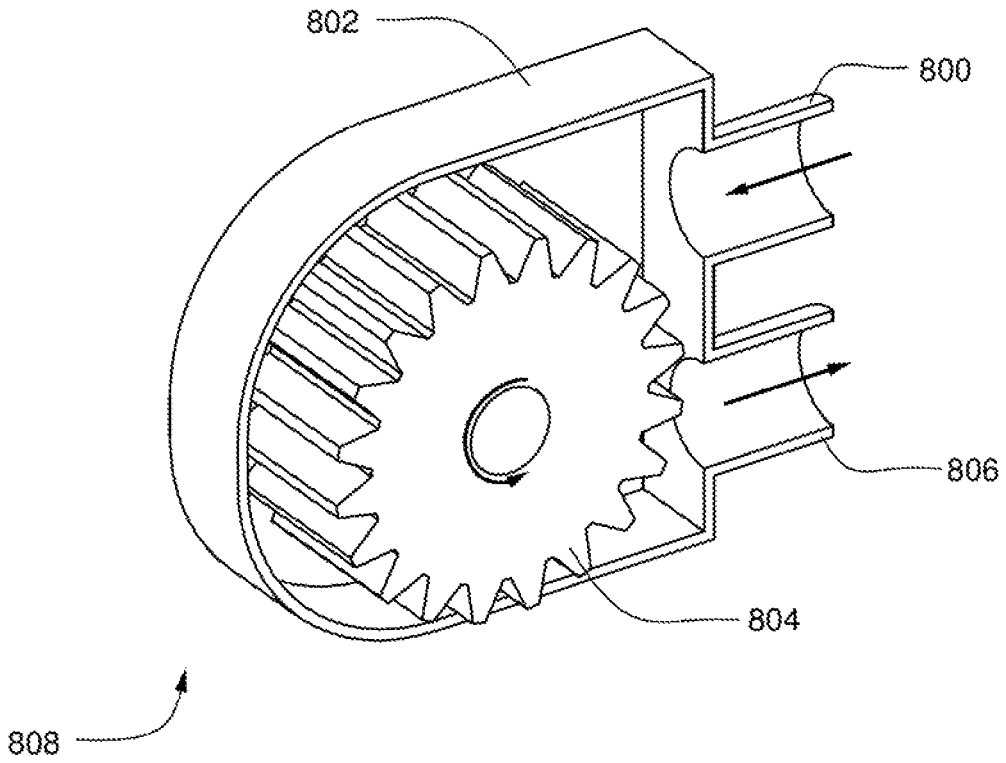
FIG. 8 is a view of another embodiment of a pump assembly having a single gear, and arrows indicating the direction of rotation and fluid flow.

FIG. 8 illustrates an alternate embodiment of a pump assembly. The pump assembly 808 includes a fluid inlet opening 800 and a casing 802 and a gear 804. The arrows in FIG. 8 indicate the direction of fluid flow and the rotation of gear 804. As water flows through inlet over gear 804, the water flows out through fluid outlet opening 806. The gear may be made of brass, plastic, another metal, or any material, including but not limited to, that which will be compatible with the fluid being pumped, is sturdy enough to withstand water flow, and can be used to make a gear. Alternate embodiments may contain a gear with wider or narrower teeth or are larger or smaller in diameter, or both. Another alternate embodiment of the pump assembly that may be used is a CO2 tank similar to those used in paint ball guns known in the art.

Figure 9:
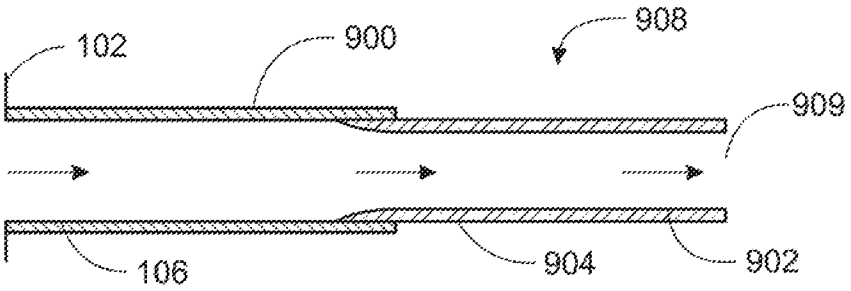
FIG. 9. is a view of an exemplary embodiment of a nozzle.
Figure 11:
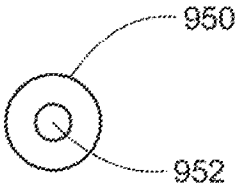
FIG. 11 is a view of an embodiment of a discharge end of a nozzle.
Figure 10:
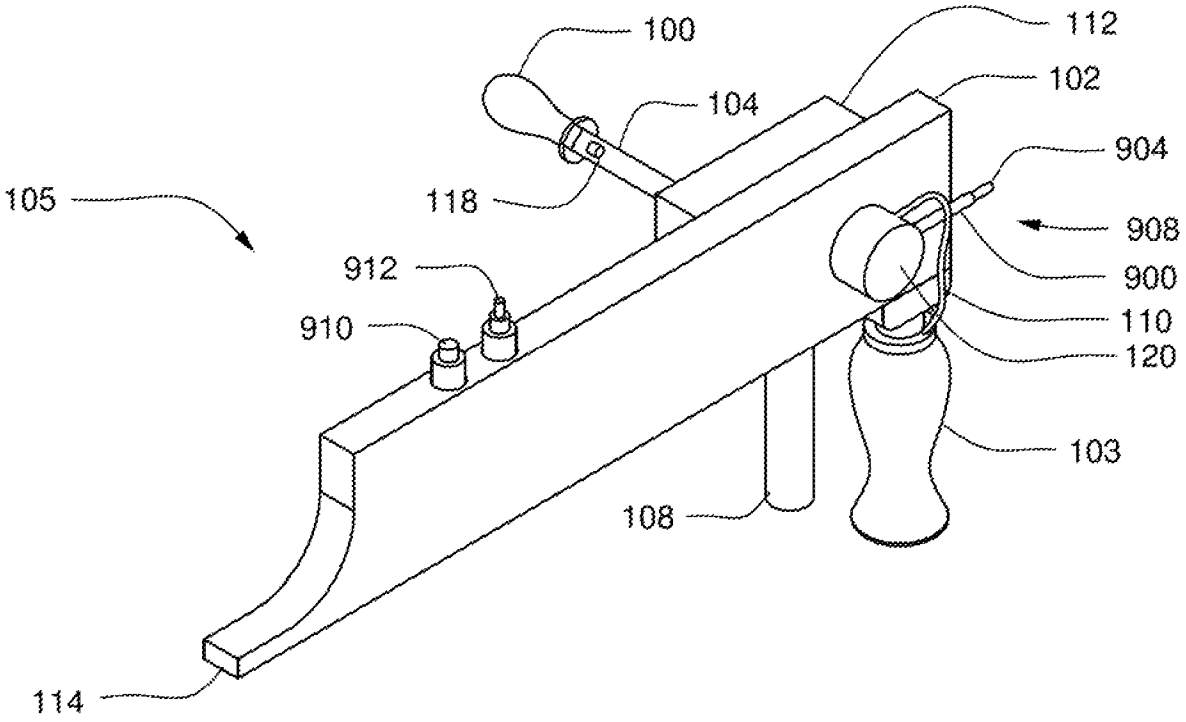
FIG. 10 is a view of an alternate embodiment of a fluid pumping device having removable nozzles, one on the fluid discharge opening and two stored on top of the housing.

FIG. 9 illustrates an exemplary embodiment of a removable nozzle 908. The nozzle is placed over fluid discharge opening 106 which extends from housing 102. Fluid discharge opening 106 may be made from silicon tubing. A nozzle base 900 fits over the tubing forming fluid discharge opening 106. A nozzle end 904 may be soldered to nozzle base 900 forming nozzle 908. Nozzle end 904 has an opening 902 drilled through it that is smaller in diameter than fluid discharge opening 106, creating a The nozzle 908 may be made from K & S brass tubing that is drilled to form varying nozzle opening sizes. The arrows in FIG. 10 demonstrate fluid flow direction through the nozzle 908. Fluid discharges from nozzle opening 909. The largest tubing in an exemplary embodiment may be brass tubing with a 1/8" outside diameter and a 3/32" inside diameter. The inside opening 902 may have razor sharp inside edges to prevent fluid from spraying and to make the fluid stream cover a greater distance. The fluid pumping device may be able to spray fluid up to approximately 45 feet, in some embodiments, when using the nozzles if the crank is turned with sufficient force. However, in other embodiments, the fluid distance may be greater or less than 45 feet. An exemplary embodiment may contain one or more removable nozzles which have varying diameters. The nozzles are placed on the fluid outlet opening, which may be made from silicon tubing. One embodiment may have nozzles ranging from 1/16" to 3/16" in diameter, however, in other embodiments, the diameter range may include nozzles having a diameter smaller than 1/16" and/or larger than 3/16". The nozzles may be made of K& S brass tubing or any material that is compatible with the fluid being pumped and sturdy enough to form a fluid stream. The nozzles may be stored anywhere on the housing or separate from the fluid pumping device. FIG. 10 shows an exemplary embodiment of fluid pumping device 105 when nozzle 908 is attached. Alternate nozzles 910 and 912 are shown stored on the top of housing 102. Nozzle base 900 is shown, as well as nozzle end 904. FIG. 11 shows the end of one embodiment of a nozzle, having an internal diameter 952 and an external diameter 950.

Figure 9A:
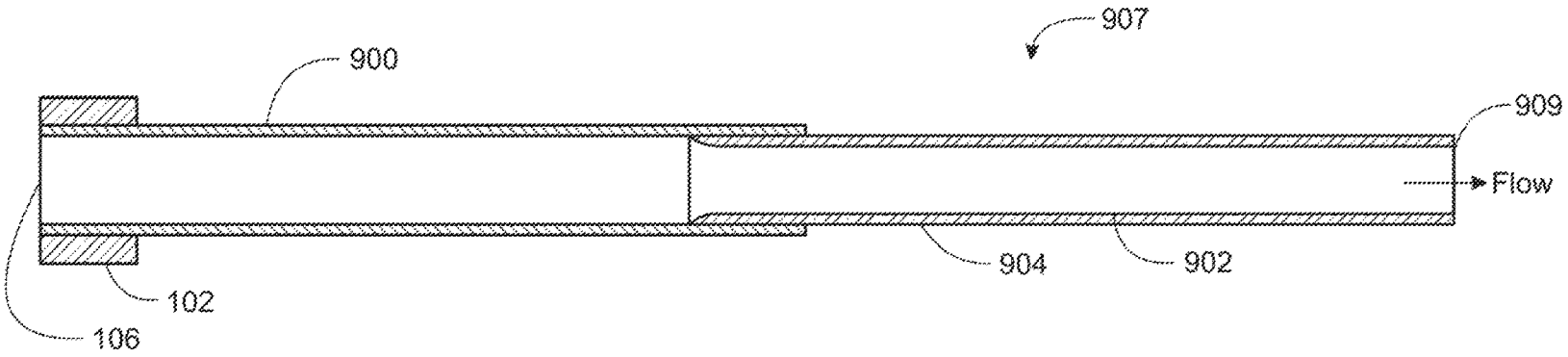
FIG. 9A is a view of one embodiment of a removable nozzle having a straight connected to the fluid discharge opening.
Figure 9B:
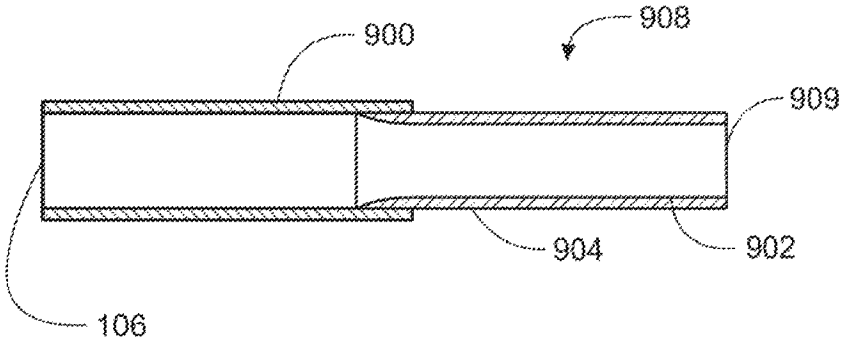
FIG. 9B is a view of another embodiment of a removable nozzle having a tapered connection to the fluid discharge opening.
Figure 12:
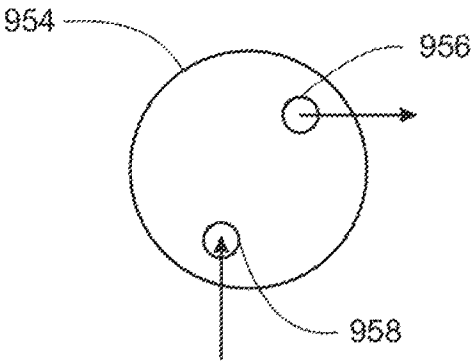
FIG. 12 is an illustrative embodiment of the fluid path leading into a nozzle according to one embodiment.
Figure 9C:
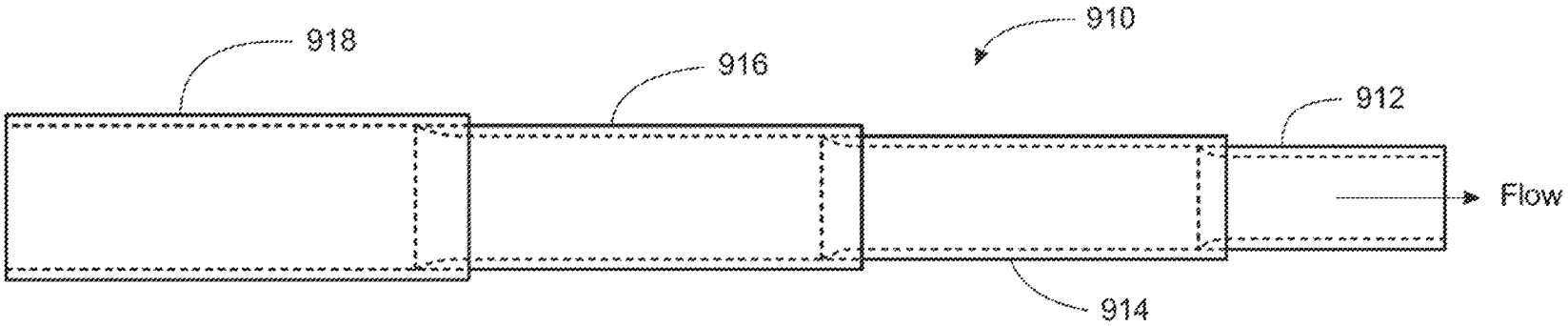
FIG. 9C is an exemplary embodiment of removable nozzles where several nozzles are stacked on top of each other.

FIG. 9A illustrates an embodiment of a nozzle 907. FIG. 9C illustrates an alternate embodiment of a nozzle 910 with nozzle pieces 912, 914, 916, and 918. The nozzle may be of any length depending on the desired size of the gun. In various embodiments, one of more varying sized nozzles, or same sized nozzles, may be used. In some embodiments, the water gun may include three varying sized nozzle notches on the housing in which to hold the nozzles. In other embodiments, greater than 3 nozzles or less than 3 nozzles may be used. In the various embodiments, the nozzle diameters may vary, in other embodiments, 2 or more nozzles may be equal in diameter, i.e., redundant nozzles. The lengths and diameters may vary, which varies the length and control of the stream of water or other fluid. Thus, in some embodiments of the toy fluid pumping gun, the control of the stream or fluid and/or the length of the stream of fluid may be variable depending on the nozzle length and/or diameter.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed is:

1. A fluid pumping device comprising:

a housing having a top;

a fluid discharge opening in the housing;

a pump assembly;

a fluid storage reservoir connected to the pump assembly;

a fluid path connected to the fluid storage reservoir and the fluid discharge opening; and a plurality of nozzles on the top of the housing wherein the nozzles are not fluidly connected to the fluid path and wherein the plurality of nozzles configured to be placed over the fluid discharge opening.

2. The fluid pumping device of claim 1 wherein the pump assembly comprising:

a first gear; and a second gear, wherein the first gear is larger in diameter than the second gear and wherein the gear ratio between the first gear and the second gear is 15:1.

3. The fluid pumping device of claim 1 further comprising a crank assembly rotatably connected to the pump assembly wherein the crank assembly operates the pump assembly.

4. The fluid pumping device of claim 1 wherein the crank assembly further comprising:

a crank arm; and a crank handle connected to the crank arm.

5. The fluid pumping device of claim 4 wherein the crank arm further comprising at least one notch and wherein the crank handle may be connected to the crank arm through the at least one notch.

6. The fluid pumping device of claim 5 wherein the crank arm further comprising at least two notches and wherein the crank handle may be connected to the crank arm through any one of the at least two notches whereby the length of the crank arm is determined by the position of the crank handle.

7. The fluid pumping device of claim 1 further comprising at least two removable nozzles, each nozzle having a different diameter opening.

8. The fluid pumping device of claim 7 wherein the at least two removable nozzles are stored on the device housing.

9. The fluid pumping device of claim 1 wherein the pump assembly comprising at least one pair of gears, wherein each pair of gears having a large gear and a pinion gear.

10. The fluid pumping device of claim 9 wherein the gear at least one pair of gears having a gear ratio of 4:1.

11. A toy water gun comprising:

a housing having a front end and a top;

a fluid discharge opening in the front end of the housing;

at least one removable nozzle removably attached to the fluid discharge opening in the front end of the housing;

a fluid storage reservoir;

a fluid path connected to the fluid storage reservoir and the fluid discharge opening; and a plurality of nozzles on the top of the housing wherein the nozzles are not fluidly connected to the fluid path and wherein the plurality of nozzles configured to be placed over the fluid discharge opening.

12. The toy water gun of claim 11 wherein the gear at least one pair of gears having a gear ratio of 4:1.

13. The toy water gun of claim 11 wherein the gear ratio between the at least one pair of gears 15:1.

14. The fluid pumping device of claim 11 further comprising a crank assembly rotatably connected to the pump assembly wherein the crank assembly operates the pump assembly.

15. The toy water gun of claim 11 wherein the crank assembly further comprising:

a crank arm; and a crank handle connected to the crank arm.

16. The toy water gun of claim 15 wherein the crank arm further comprising at least one notch and wherein the crank handle may be connected to the crank arm through the at least one notch.

17. The toy water gun of claim 16 wherein the crank arm further comprising at least two notches and wherein the crank handle may be connected to the crank arm through any one of the at least two notches whereby the length of the crank arm is determined by the position of the crank handle.

18. The toy water gun of claim 11 further comprising at least two removable nozzles, each nozzle having a different diameter opening.

19. The toy water gun of claim 18 wherein the at least two removable nozzles are stored on the device housing.

20. The toy water gun of claim 11 further comprising a pump assembly.

* * * * *